US010344750B2

(12) United States Patent
Wang

(10) Patent No.: US 10,344,750 B2
(45) Date of Patent: Jul. 9, 2019

(54) HAND PUMP WITH AIR STORAGE TANK

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 217 days.

(21) Appl. No.: 15/066,033

(22) Filed: Mar. 10, 2016

(65) Prior Publication Data

US 2017/0261007 A1 Sep. 14, 2017

(51) Int. Cl.
*F04B 33/00* (2006.01)
*F04B 41/02* (2006.01)

(52) U.S. Cl.
CPC ..... *F04B 41/02* (2013.01); *F04B 33/00* (2013.01); *F04B 33/005* (2013.01)

(58) Field of Classification Search
CPC ..... F15B 1/027; F04B 41/02; F04B 33/00; F04B 11/0008; B60C 29/00
USPC ..... 417/547
See application file for complete search history.

(56) References Cited

U.S. PATENT DOCUMENTS 5,590,696 A 1/1997 Phillips et al.
6,652,242 B2 11/2003 Wu
6,676,390 B2 * 1/2004 Wang ..... F04B 33/00 417/468
6,883,565 B2 4/2005 Marui
8,721,296 B1 * 5/2014 Wang ..... F04B 33/005 137/565.15
2013/0087228 A1 * 4/2013 Wang ..... F16K 31/52416 137/565.12
2016/0010637 A1 * 1/2016 Chuang ..... F04B 33/005 417/63
2016/0097409 A1 * 4/2016 Yang ..... F04B 53/14 92/5 R
2016/0231185 A1 * 8/2016 Wu ..... F04B 33/00

* cited by examiner

*Primary Examiner* — Essama Omgba
*Assistant Examiner* — Stephen A Mick
(74) *Attorney, Agent, or Firm* — Charles E. Baxley

(57) ABSTRACT

A hand pump includes a receptacle extended upwardly from a base, a housing attached to the base and having a port connected to a pressure gauge, a hose coupled to the housing and having a nozzle for inflating tires or objects, a sleeve slidably engaged onto the receptacle, and a check valve engaged in the receptacle for controlling the pressurized air to flow only from the sleeve into the receptacle and for preventing the pressurized air from flowing backward from the receptacle into the sleeve in order to generate the pressurized air in the receptacle, and for allowing the receptacle to store the pressurized air when required. A control valve device controls the pressurized air to flow out of the housing.

2 Claims, 11 Drawing Sheets

HAND PUMP WITH AIR STORAGE TANK

BACKGROUND OF THE INVENTION

1. Field of the Invention

The present invention relates to a hand pump or air pump for inflating the inflatable tires or objects or the like of the cycles, such as the bicycles, and more particularly to a hand pump or air pump for a bicycle including a hidden or concealed air storage tank for storing the pressurized air and including a control valve device for controlling the outward supplying of the pressurized air through a nozzle and for allowing the pressurized air to be easily controlled and operated or supplied out to inflate the inflatable tires or objects or the like.

2. Description of the Prior Art

Typical hand pumps or air pumps or manual pumps comprise a tubular or cylindrical housing including a stand attached or mounted or secured to the bottom portion thereof for supporting the tubular or cylindrical housing in or at an upright status, and a handle attached or mounted or secured to the upper portion thereof for actuating or operating the piston to move in a reciprocating action within the tubular or cylindrical housing in order to pump and to generate the pressurized air and to supply the pressurized air out of the tubular or cylindrical housing.

For example, U.S. Pat. No. 5,590,696 to Phillips et al., U.S. Pat. No. 6,652,242 to Wu, U.S. Pat. No. 6,676,390 to Wang, U.S. Pat. No. 6,883,565 to Marui, and U.S. Pat. No. 8,721,296 to Wang disclose several of the typical hand pumps or air pumps or manual pumps for bicycles each comprising a tubular or cylindrical housing including a bottom stand and an upper handle, and an air storage tank coupled to and communicating with the tubular or cylindrical housing for receiving and storing the pressurized air from the tubular or cylindrical housing of the manual pump and for selectively supplying the pressurized air to inflate the inflatable tires or objects or the like.

However, the pressurized air may not be accommodated or stored within the cylindrical housing, but may be continuously supplied out to inflate the inflatable tires or objects or the like, such that an additional air storage tank is required to be provided and attached or coupled to the cylindrical housing for storing the pressurized air, and the users may not easily control and operate the manual pump and the air storage tank, or the manual pump and the air storage tank may not be easily actuated or operated or controlled by the user to supply the pressurized air out to inflate the inflatable tires or objects or the like, and the user may have to switch or change many parts or elements or control members before the pressurized air may be supplied out to inflate the inflatable tires or objects or the like.

The present invention has arisen to mitigate and/or obviate the afore-described disadvantages of the conventional hand pumps or air pumps or manual pumps and the air storage tank combinations or assemblies.

SUMMARY OF THE INVENTION

The primary objective of the present invention is to provide a hand pump or air pump for a bicycle including a hidden or concealed air storage tank for storing the pressurized air and having a control valve device for controlling the outward supplying of the pressurized air through a nozzle and for allowing the pressurized air to be easily controlled and operated or supplied out to inflate the inflatable tires or objects or the like.

In accordance with one aspect of the invention, there is provided a hand pump comprising a base including a chamber formed therein, and including a receptacle extended upwardly from the base, and the receptacle including a compartment formed therein and communicating with the chamber of the base for receiving and storing a pressurized air, a piping mechanism including a housing attached to the base and including a space formed in the housing and communicating with the compartment of the receptacle for allowing the pressurized air to flow from the compartment of the receptacle into the space of the housing, the housing including a port, a pressure gauge connected to the port of the housing for displaying a pressure in the space of the housing, a hose coupled to the housing for receiving the pressurized air from the housing, and including a nozzle attached to the hose, a sleeve slidably engaged onto the receptacle and movable along the receptacle, and a check valve engaged in the receptacle for controlling the pressurized air to flow only from the sleeve into the compartment of the receptacle, and for preventing the pressurized air from flowing backward from the compartment of the receptacle into the sleeve, in order to generate the pressurized air within the compartment of the receptacle and for supplying the pressurized air to the hose selectively, and thus for allowing the receptacle to temporarily accommodate or store the pressurized air when required.

The piping mechanism includes a casing coupled to the hose, the casing includes a mouth engaged with the housing and includes a bore formed in the casing and communicating with the space of the housing for receiving the pressurized air from the space of the housing. The piping mechanism includes a control valve device engaged in the bore of the casing for controlling and limiting the pressurized air to flow outward through the bore of the casing and into the hose and the nozzle.

The casing includes a lateral pathway formed therein and communicating with the bore of the casing, and a cam member rotatably engaged in the pathway of the casing and contacted and engaged with the control valve device for actuating or controlling or rotating the control valve device to open and to close the bore of the casing.

The casing includes a handle attached to the cam member for actuating or rotating the cam member and for operating the control valve device to open and to close the bore of the casing. The base includes a cover mounted onto the base for covering and shielding the pressure gauge.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
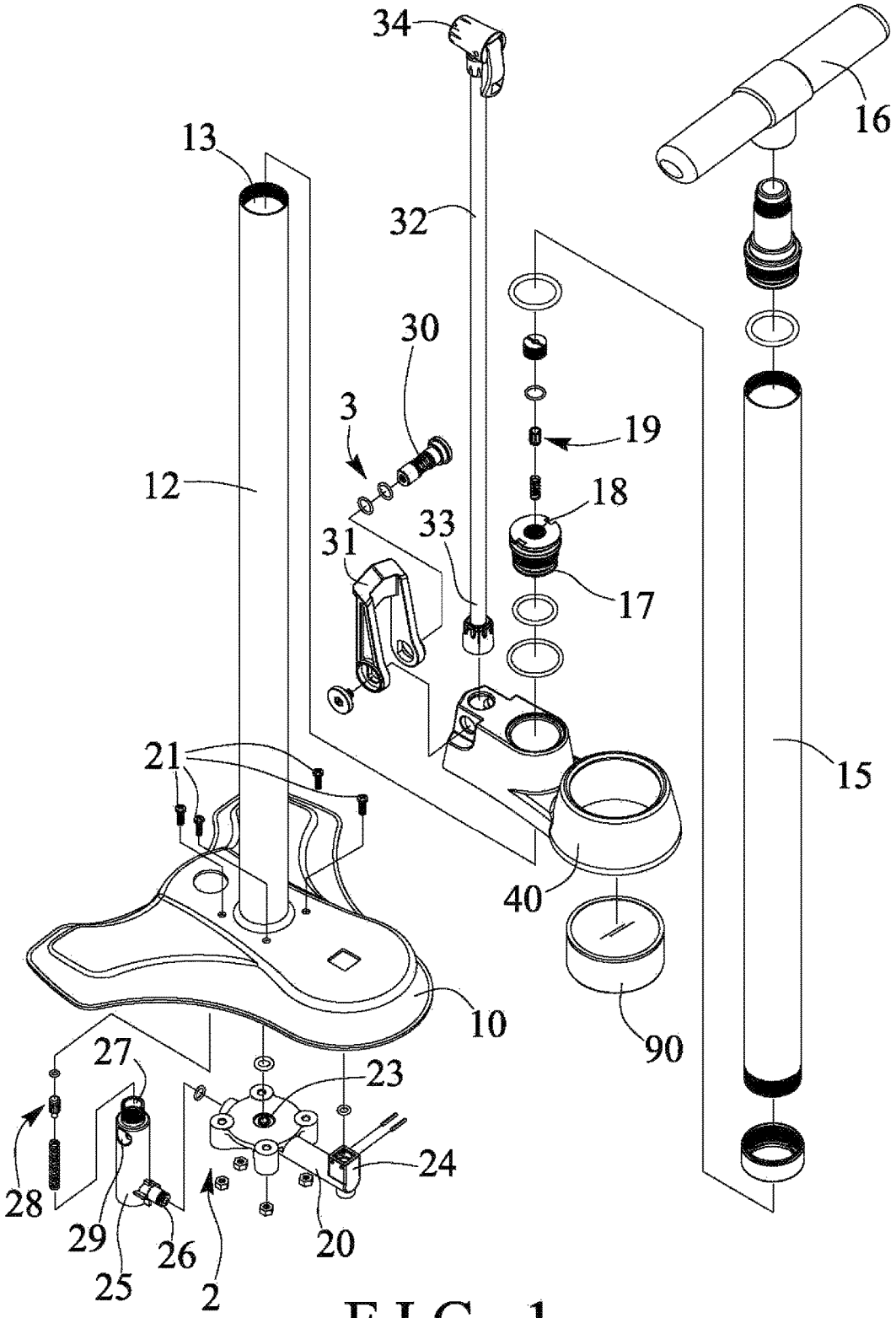
FIG. 1 is a partial exploded view of a hand pump or air pump in accordance with the present invention.
Figure 2:
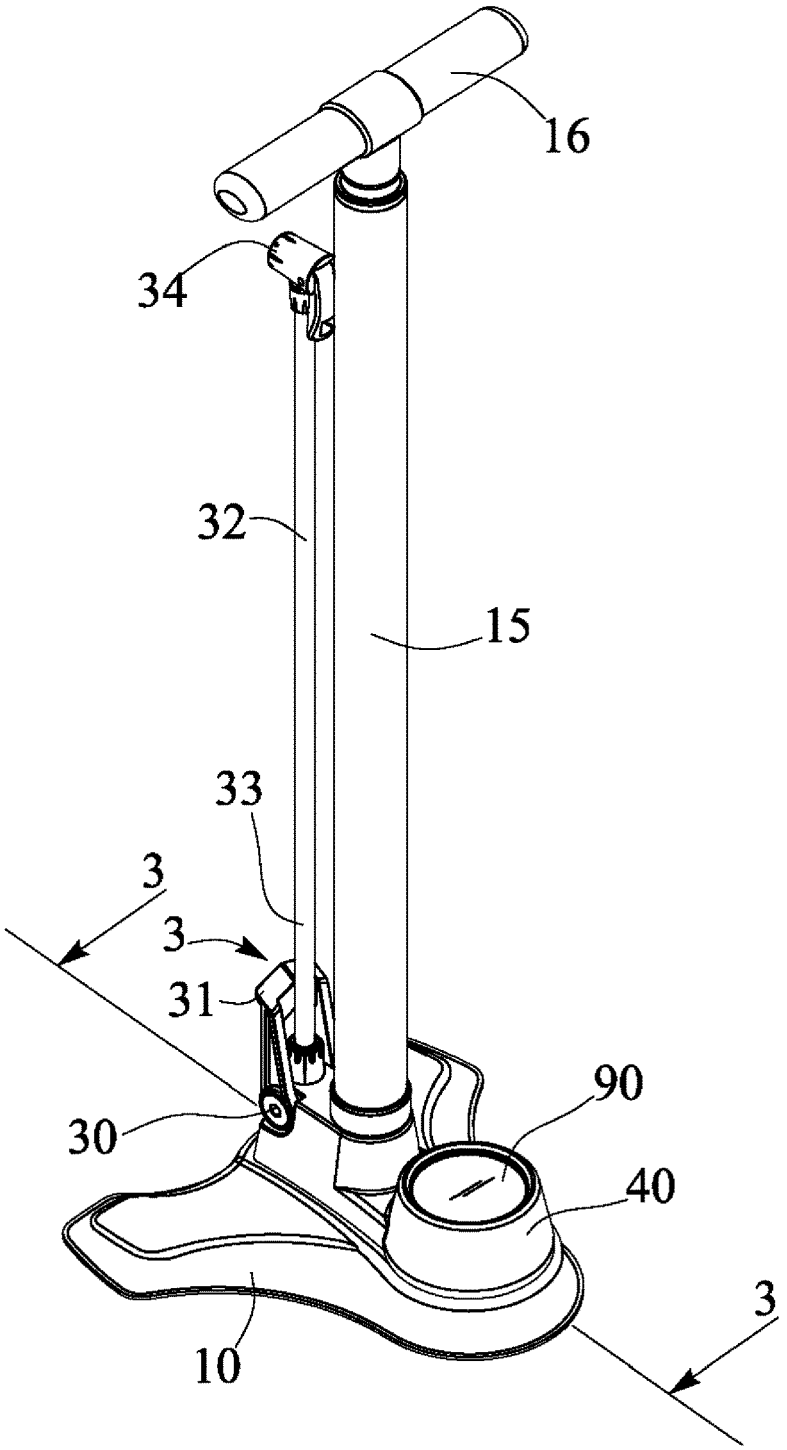
FIG. 2 is a perspective view of the hand pump or air pump.
Figure 3:
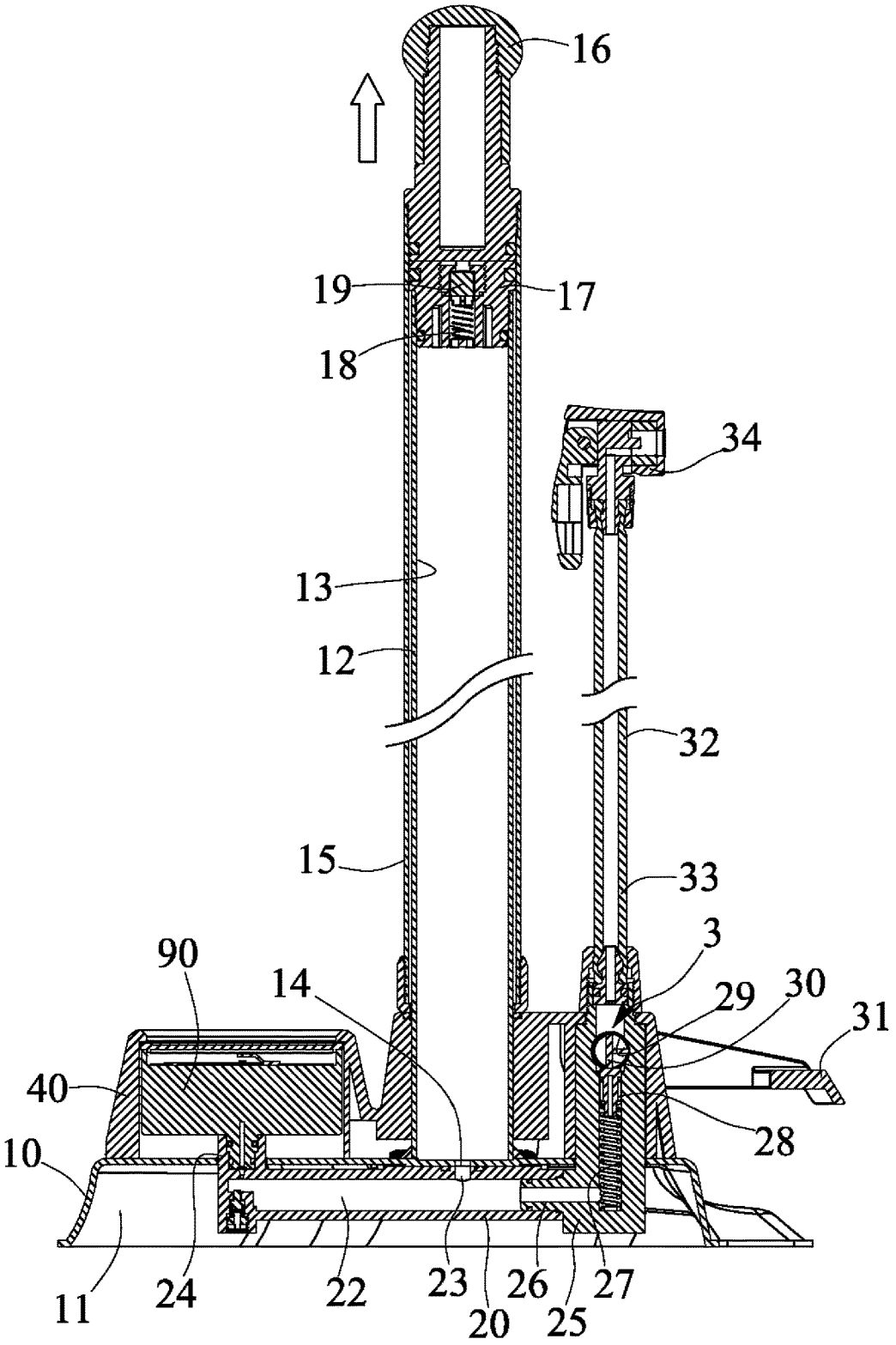
FIG. 3 is a cross sectional view of the hand pump or air pump, taken along lines 3-3 of FIG. 2.

Referring to the drawings, and initially to FIGS. 1-3, a hand pump or air pump in accordance with the present invention comprises a stand or base 10 including a compartment or chamber 11 formed therein (FIGS. 3-5), and including a cylindrical or tubular housing or member or receptacle 12 extended upwardly from the base 10, and the receptacle 12 includes a chamber or compartment 13 formed therein, and an orifice or passage 14 formed in the lower or bottom portion of the receptacle 12 or of the base 10 and communicating with the compartment 13 of the receptacle 12 and the chamber 11 of the base 10 for allowing the air to flow from the compartment 13 of the receptacle 12 into the chamber 11 of the base 10. A barrel or sleeve 15 is slidably disposed or attached or mounted or engaged onto the receptacle 12 and slidable or movable up and down along the receptacle 12, and a handle 16 is attached or mounted or secured to the upper portion of the sleeve 15 for moving the sleeve 15 relative to the receptacle 12.

A cap 17 is attached or mounted or secured to the upper portion of the receptacle 12, and includes an orifice 18 formed therein, and a control valve or check valve 19 is disposed or attached or mounted or engaged into the orifice 18 of the cap 17 for controlling the air to flow only from the sleeve 15 into the compartment 13 of the receptacle 12, and for preventing the air from flowing backward from the compartment 13 of the receptacle 12 into the sleeve 15, and thus for generating a pressurized air within the compartment 13 of the receptacle 12 and for supplying the pressurized air through the passage 14 and into the chamber 11 of the base 10. A piping mechanism 2 includes a housing 20 disposed or engaged in the chamber 11 of the base 10, and attached or mounted or secured to the base 10 with such as fasteners 21, and includes a space 22 formed therein, and includes an inlet opening 23 formed therein and communicating with the space 22 of the housing 20 and aligned with or communicating with the passage 14 of the receptacle 12 or of the base 10 for allowing the pressurized air to flow into the space 22 of the housing 20.

The housing 20 includes a port 24 partially extended out of the base 10 for connecting or coupling to a pressure gauge 90 and for sensing and showing or displaying the pressure in the space 22 of the housing 20. The piping mechanism 2 further includes a casing 25 partially extended out of the base 10 and having a port or mouth 26 attached or mounted or engaged with the housing 20 and having a bore 27 formed therein and communicating with the space 22 of the housing 20 for receiving the pressurized air from the space 22 of the housing 20, and a control valve device 28 is received or engaged in the bore 27 of the casing 25 for controlling the flowing of the pressurized air through the bore 27 of the casing 25. The casing 25 further includes a lateral conduit or pathway 29 formed therein and intersecting or communicating with the bore 27 of the casing 25 for pivotally or rotatably receiving or engaging with a shank or cam member 30 of an actuating device 3, in which the cam member 30 of the actuating device 3 is contacted or engaged with the control valve device 28 (FIGS. 3-5).

A hose 32 includes one or first end portion 33 engaged with or connected or coupled to the casing 25 for receiving the pressurized air from the housing 20 and the casing 25, and includes a mouth or nozzle 34 attached or mounted or secured to the other or second end portion thereof for engaging with various kinds of air inflatable facilities or devices (not illustrated) and for filling or supplying the pressurized air to inflate the inflatable facilities or devices. Accordingly, as shown in FIGS. 3-5, the pressurized air from the receptacle 12 and the housing 20 and the casing 25 may be supplied out through the hose 32 and the nozzle 34 to inflate the inflatable facilities or devices selectively. The cam member 30 of the actuating device 3 is contacted or engaged with the control valve device 28 and may actuate and move the control valve device 28 to control the flowing of the pressurized air through the bore 27 of the casing 25.

Figure 4:
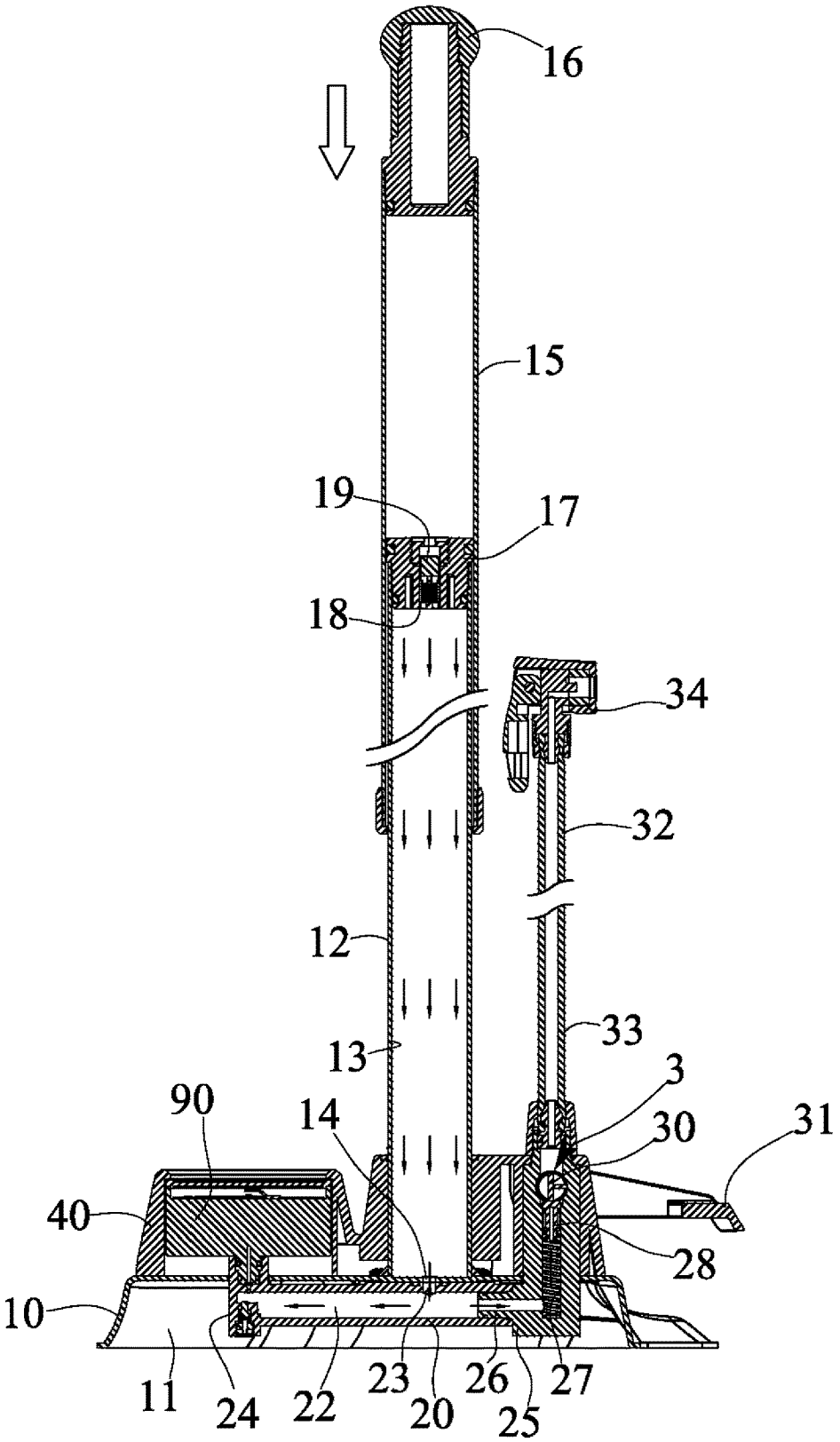
FIGS. 4, 5 are cross sectional views of the hand pump or air pump, similar to FIG. 3, illustrating the operation of the hand pump or air pump.
Figure 5:
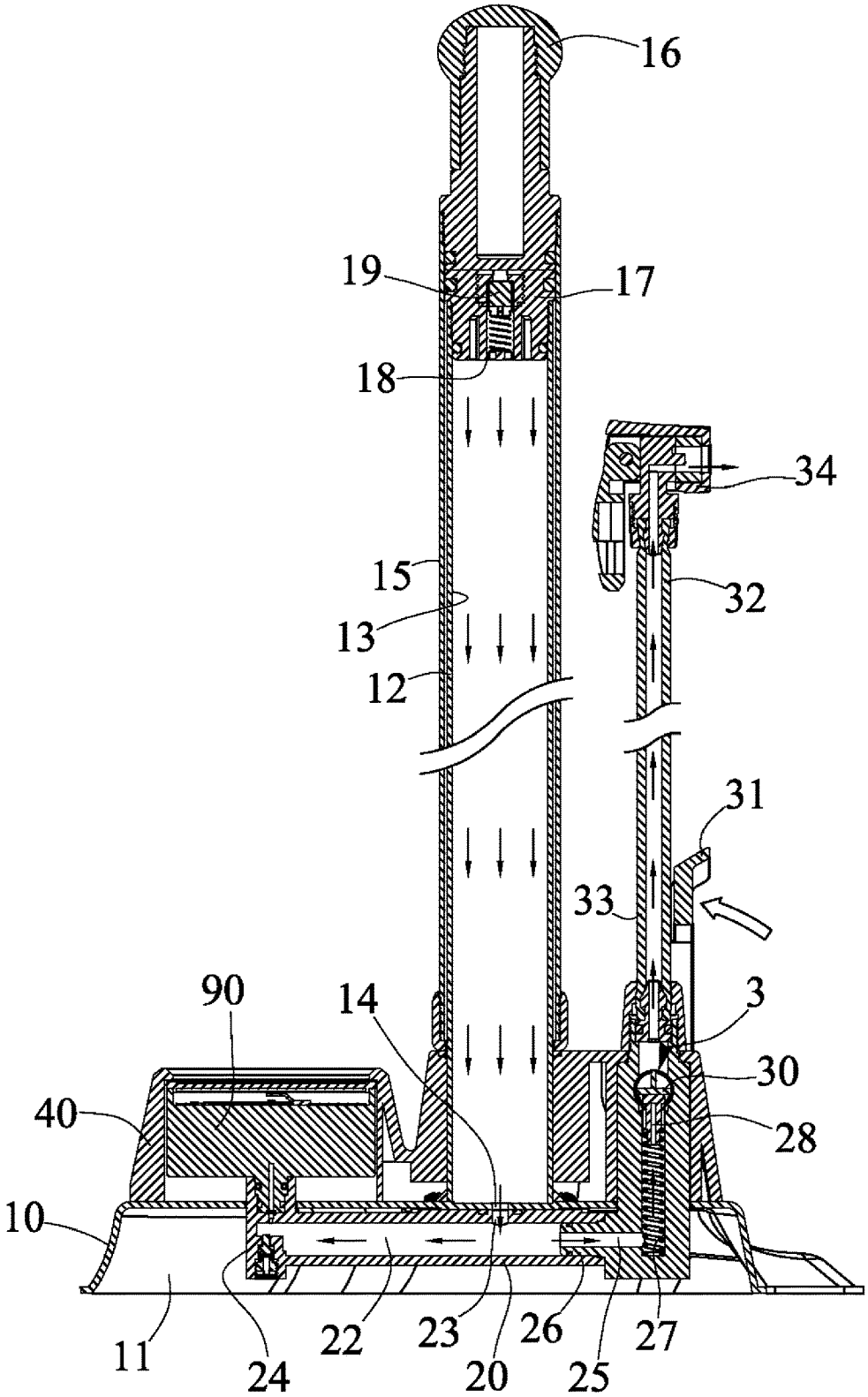
Figure 6:
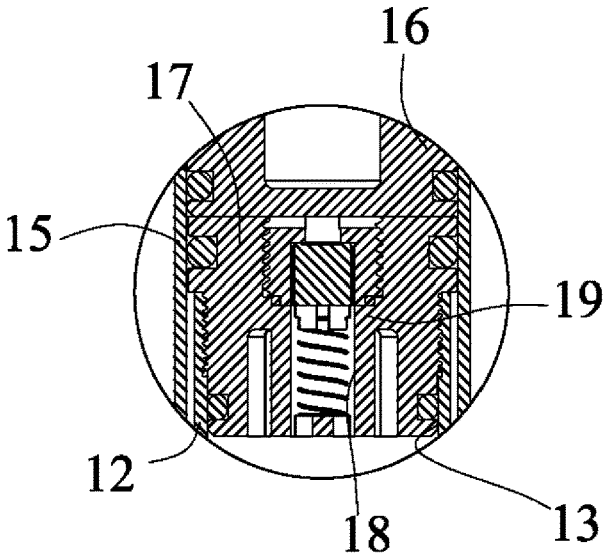
FIGS. 6, 7 are enlarged partial cross sectional views of the hand pump or air pump as shown in FIGS. 3, 4 respectively.

For example, as shown in FIGS. 3 and 4, the control valve device 28 may normally block or seal the bore 27 of the casing 25 for preventing the pressurized air from flowing through the bore 27 of the casing 25, and for allowing the pressurized air to be contained and stored within the receptacle 12 and the housing 20 and the casing 25. On the contrary, as shown in FIG. 5, the cam member 30 of the actuating device 3 may be actuated or operated and pivoted or rotated relative to the casing 25 with a handle 31 which is attached or mounted or secured to the cam member 30 for selectively opening the bore 27 of the casing 25, and for allowing the pressurized air to flow into the hose 32 and the nozzle 34 selectively. After use, the cam member 30 of the actuating device 3 may further be actuated or operated and pivoted or rotated relative to the casing 25 with the handle 31 again, until the control valve device 28 blocks or seals the bore 27 of the casing 25 again. A hood or container or cover 40 may further be provided and attached or mounted or secured onto the base 10 for covering or shielding the pressure gauge 90 and the first end portion 33 of the hose 32.

Figure 7:
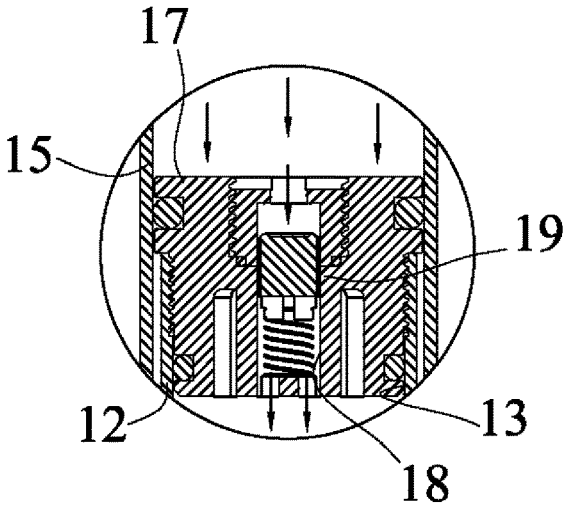

In operation, as shown in FIGS. 4 and 7, when the sleeve 15 is forced and moved relative to the receptacle 12 and/or moved toward the receptacle 12 and the base 10, the air in the sleeve 15 may be forced to move bypass or through the check valve 19 and into the compartment 13 of the receptacle 12 for generating the pressurized air within the compartment 13 of the receptacle 12, and the pressurized air may then be supplied through the passage 14 of the receptacle 12 or of the base 10 and into the space 22 of the housing 20 until the pressurized air reaches a predetermined or required value of the pressure which may be shown and read from the pressure gauge 90. At this moment, the cam member 30 of the actuating device 3 may actuate or operate the control valve device 28 to block or seal the bore 27 of the casing 25 for preventing the pressurized air from flowing out through the bore 27 of the casing 25. The check valve 19 may prevent the pressurized air from flowing backward from the compartment 13 of the receptacle 12 into the sleeve 15.

As shown in FIG. 5, when it is required to supply the pressurized air to inflate the inflatable facilities or devices, the handle 31 may actuate or operate and pivot or rotate the cam member 30 of the actuating device 3 relative to the casing 25 in order to release the control valve device 28, and for allowing the pressurized air to flow into the hose 32 and the nozzle 34 selectively and to inflate the inflatable facilities or devices. It is to be noted that the sleeve 15 may still be forced and moved toward the receptacle 12 and the base 10 to further generate the pressurized air into the compartment 13 of the receptacle 12 even when the pressurized air is supplied and flown into the hose 32 and the nozzle 34. In addition, it is further to be noted that the compartment 13 of the receptacle 12 may be provided for storing the pressurized air without additional air tank or container.

Figure 8:
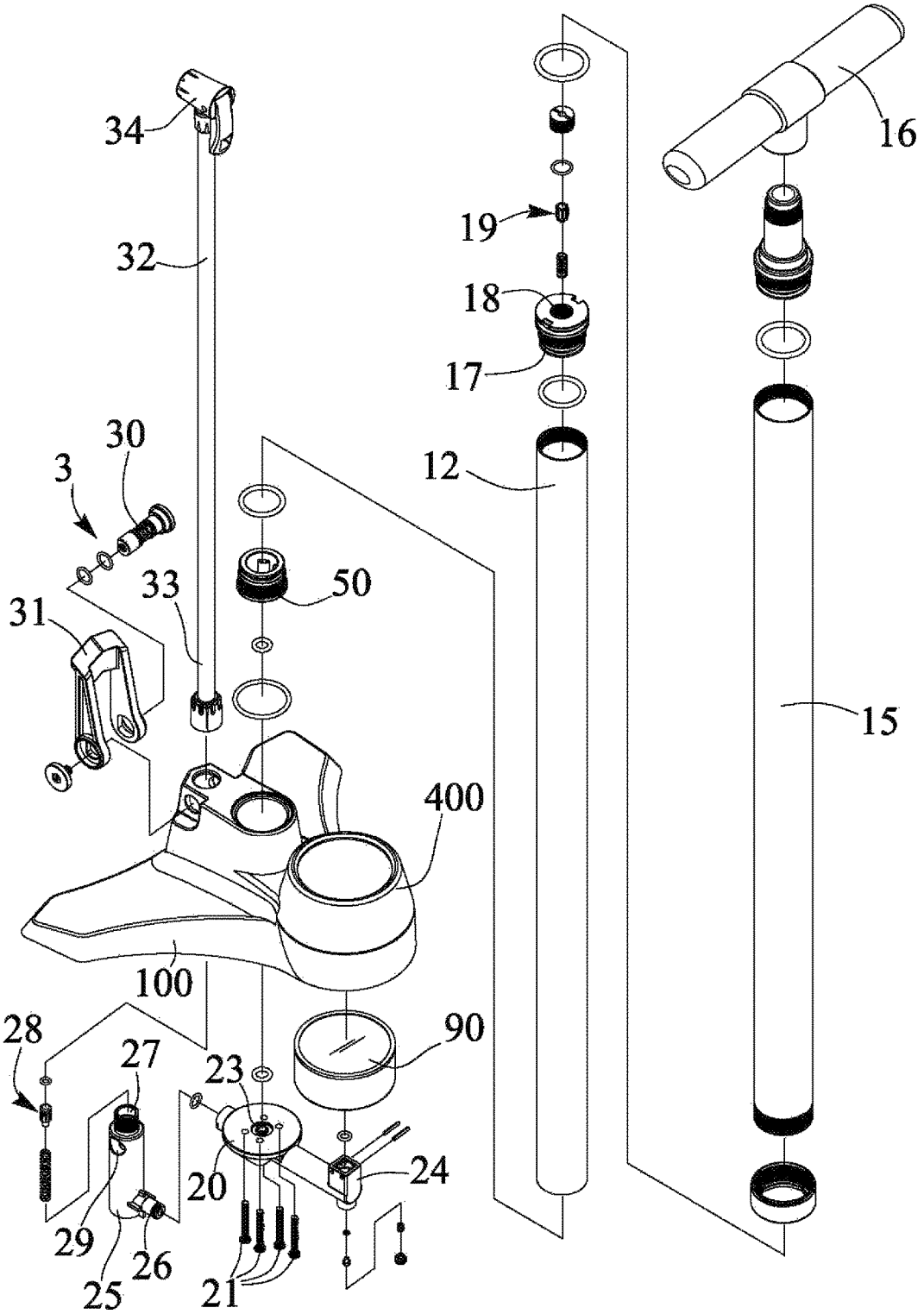
FIG. 8 is another partial exploded view similar to FIG. 1, illustrating the other arrangement of the hand pump or air pump.
Figure 9:
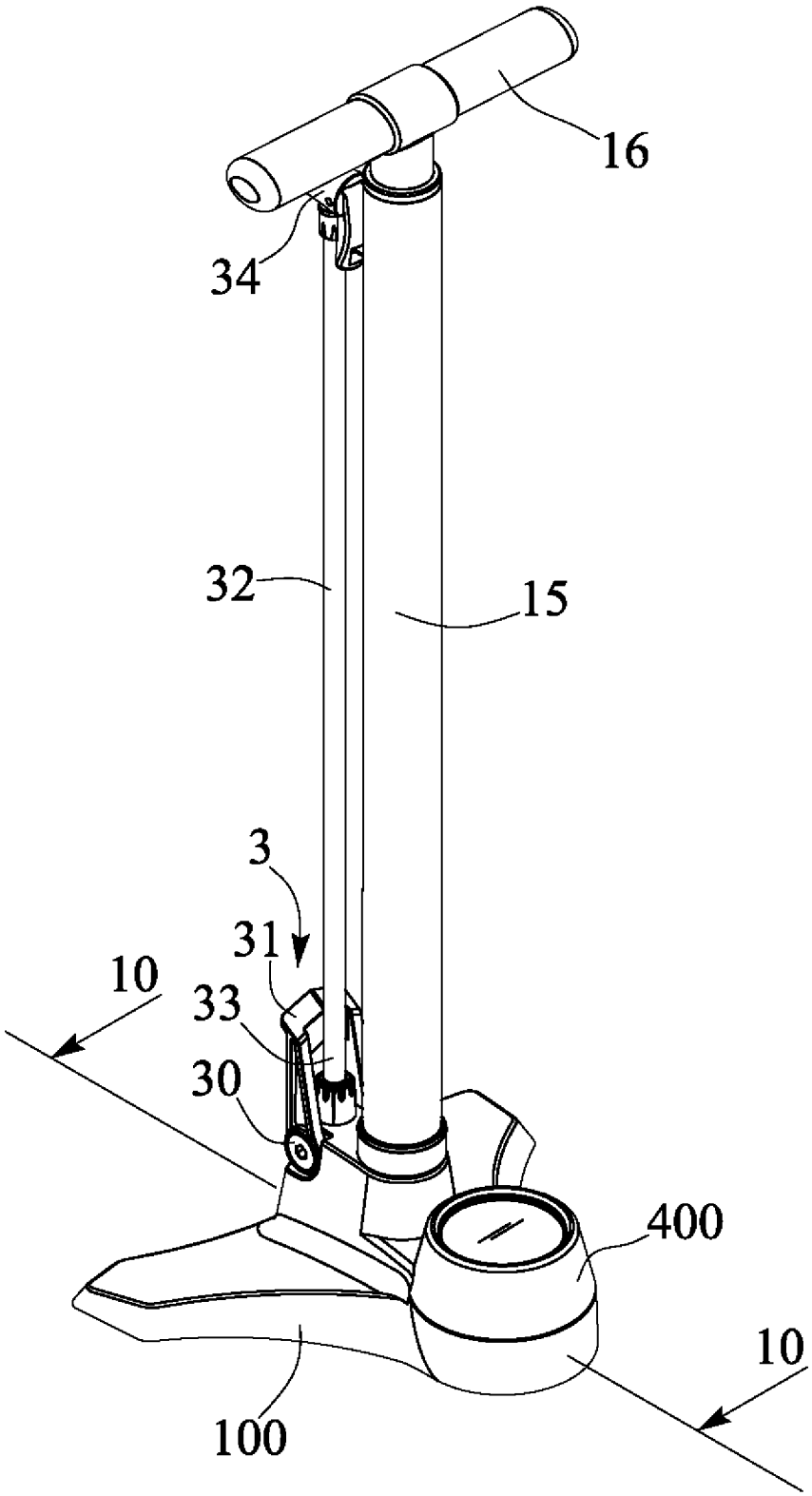
FIG. 9 is a perspective view of the hand pump or air pump as shown in FIG. 8.
Figure 10:
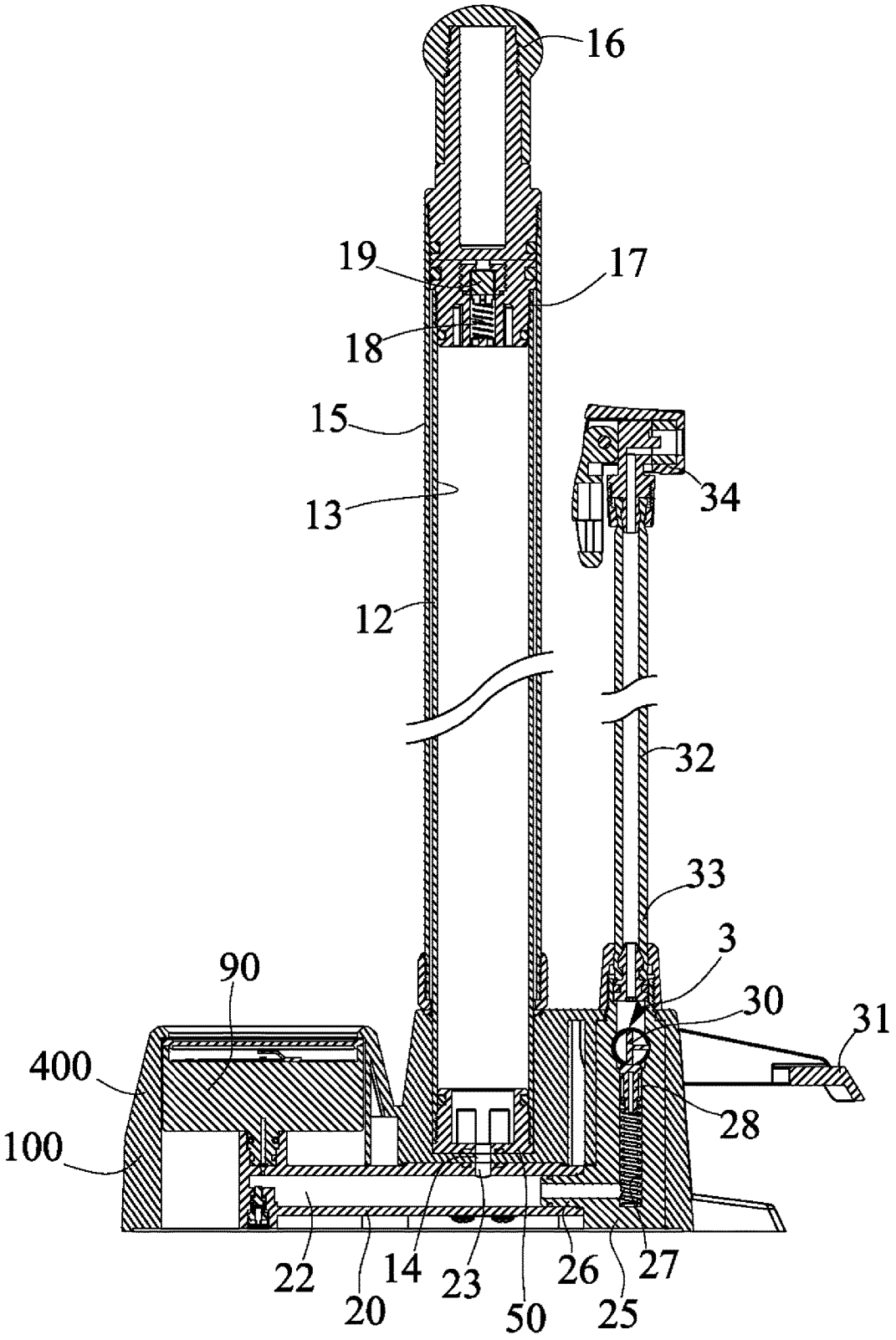
FIG. 10 is a cross sectional view of the hand pump or air pump, taken along lines 10-10 of FIG. 9.
Figure 11:
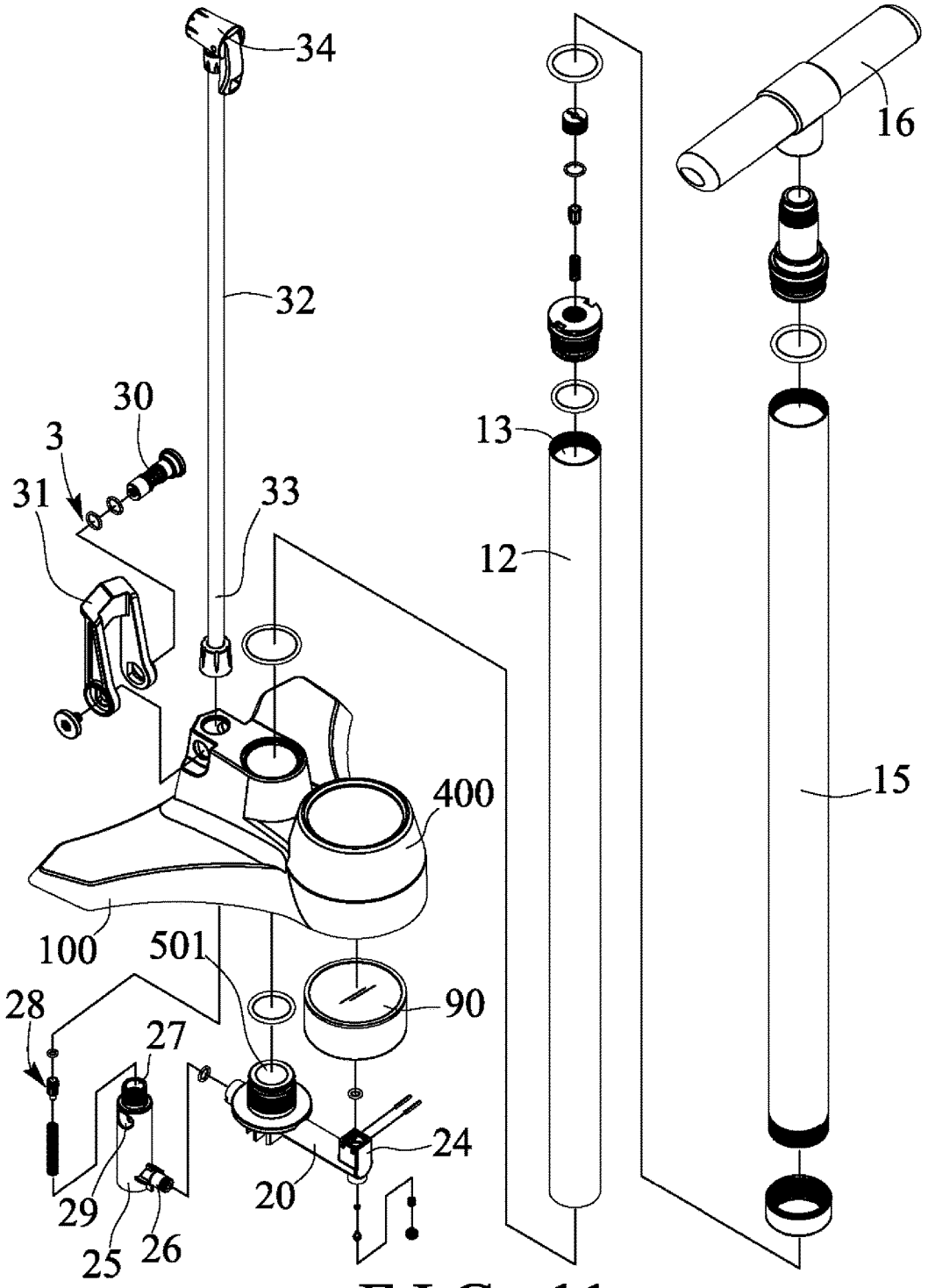
FIG. 11 is a further partial exploded view similar to FIGS. 1 and 8, illustrating the further arrangement of the hand pump or air pump.
Figure 12:
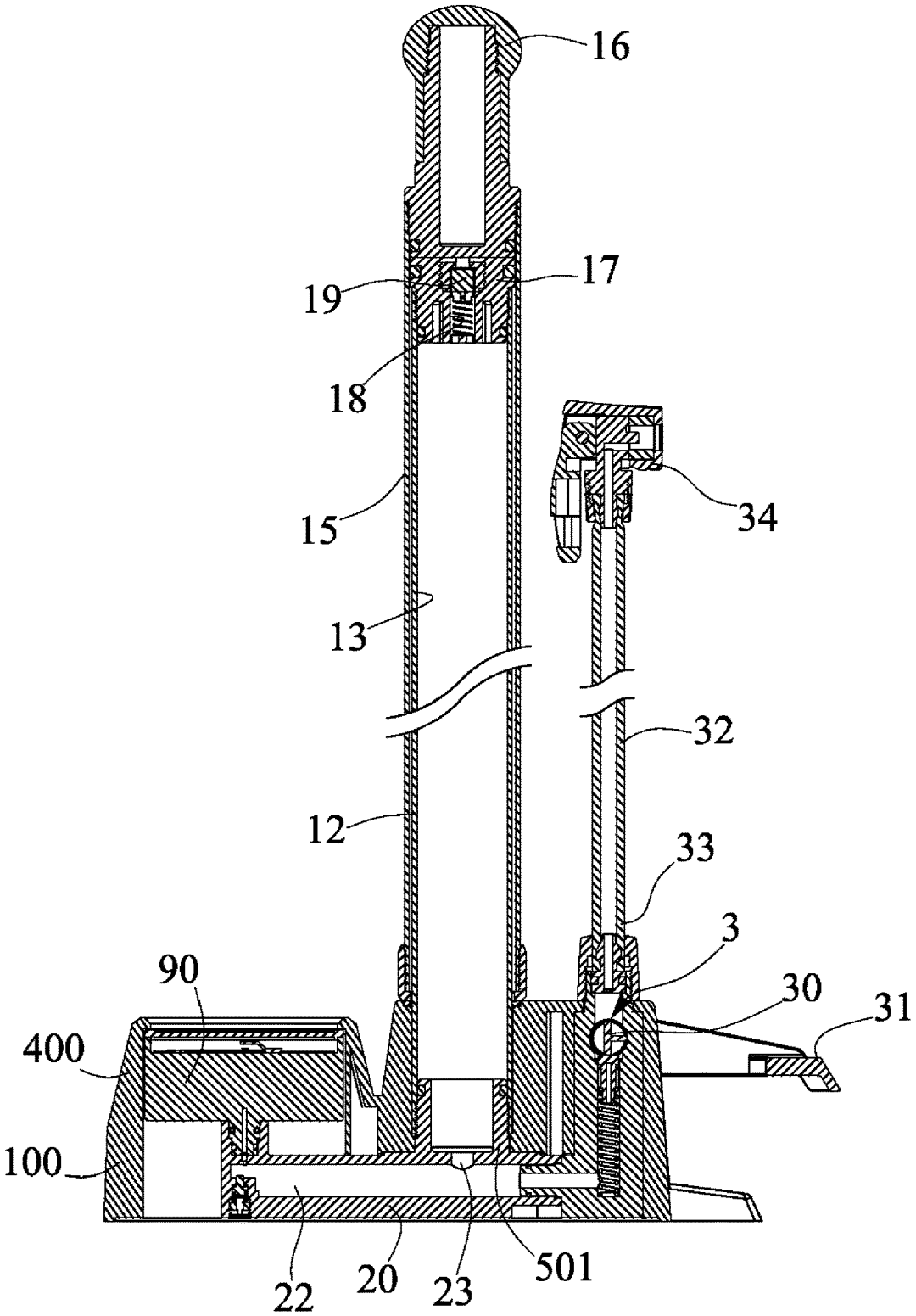
FIG. 12 is a cross sectional view of the hand pump or air pump as shown in FIG. 11.

Alternatively, as shown in FIGS. 8-10, the cover 400 may be solidly and stably attached or mounted or secured onto the base 100 and formed integral with the base 100 as a one-integral-piece structure or configuration, and a coupler or adaptor 50 may further be provided and attached or mounted or secured into the base 100 or the cover 400 for connecting or coupling or securing the receptacle 12 to the base 100. Further alternatively, as shown in FIGS. 11-12, the adaptor 501 may be formed integral with the housing 20 and engaged into the base 100 and/or the cover 400 for connecting or coupling or securing the receptacle 12 to the base 100. The compartment 13 of the receptacle 12 may also be provided for storing the pressurized air without providing additional air tank or container.

Accordingly, the hand pump or air pump in accordance with the present invention includes a hidden or concealed air storage tank for storing the pressurized air and having a control valve device for controlling the outward supplying of the pressurized air through a nozzle and for allowing the pressurized air to be easily controlled and operated or supplied out to inflate the inflatable tires or objects or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hand pump comprising:

a base including a chamber formed therein, and including a receptacle extended upwardly from said base, and said receptacle including a compartment formed therein and communicating with said chamber of said base for receiving and storing a pressurized air, a cap attached to said receptacle, said cap including an orifice formed in said cap, a piping mechanism including a housing attached to said base and including a space formed in said housing and communicating with said compartment of said receptacle for allowing the pressurized air to flow from said compartment of said receptacle into said space of said housing, said housing including a port, a pressure gauge connected to said port of said housing for displaying a pressure in said space of said housing, a hose coupled to said housing for receiving the pressurized air from said housing, and including a nozzle attached to said hose, said piping mechanism including a casing coupled to said hose, said casing including a mouth engaged with said housing and including a bore formed in said casing and communicating with said space of said housing for receiving the pressurized air from said space of said housing, said casing including a lateral pathway formed therein and communicating with said bore of said casing, said piping mechanism including a control valve device engaged in said bore of said casing for controlling the pressurized air to flow through said bore of said casing, a cam member rotatably engaged in said pathway of said casing and contacted and engaged with said control valve device for controlling said control valve device to open and to close said bore of said casing, a handle attached to said cam member for actuating said cam member to operate said control valve device, a sleeve slidably engaged onto said receptacle and movable along said receptacle, and a check valve engaged in said orifice of said cap for controlling the pressurized air to flow only from said sleeve into said compartment of said receptacle, and for preventing the pressurized air from flowing backward from said compartment of said receptacle into said sleeve, in order to generate the pressurized air within said compartment of said receptacle, and to store the pressurized air between said check valve of said cap and said control valve device, and for supplying the pressurized air to said hose selectively.

2. The hand pump as claimed in claim 1, wherein said base includes a cover mounted onto said base for covering and shielding said pressure gauge.

* * * * *